US010329932B2

(12) United States Patent
Spangler et al.

(10) Patent No.: US 10,329,932 B2
(45) Date of Patent: Jun. 25, 2019

(54) BAFFLE INSERTS

(71) Applicant: UNITED TECHNOLOGIES CORPORATION, Farmington, CT (US)

(72) Inventors: Brandon W. Spangler, Vernon, CT (US); Gina Cavallo, Watertown, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 971 days.

(21) Appl. No.: 14/635,168

(22) Filed: Mar. 2, 2015

(65) Prior Publication Data

US 2016/0258306 A1 Sep. 8, 2016

(51) Int. Cl.
*F01D 5/18* (2006.01)
*F01D 9/06* (2006.01)
(Continued)

(52) U.S. Cl.
CPC ..... *F01D 9/065* (2013.01); *F01D 5/188* (2013.01); *F01D 9/041* (2013.01); *F01D 25/12* (2013.01); *F05D 2220/32* (2013.01); *F05D 2230/64* (2013.01); *F05D 2230/642* (2013.01); *F05D 2240/12* (2013.01); *F05D 2240/126* (2013.01); *F05D 2260/221* (2013.01)

(58) Field of Classification Search
CPC ..... F01D 9/065; F01D 5/188; F01D 8/189
See application file for complete search history.

(56) References Cited

U.S. PATENT DOCUMENTS 3,388,888 A * 6/1968 Kercher ..... F01D 5/189 415/115
3,966,357 A * 6/1976 Corsmeier ..... F01D 5/189 416/500

(Continued)

FOREIGN PATENT DOCUMENTS

| | | | |
|---|---|---|---|
| EP | 0182588 | A1 | 5/1986 |
| EP | 2708296 | A2 | 3/2014 |
| GB | 2017229 | A | 10/1979 |

OTHER PUBLICATIONS

U.S. Appl. No. 62/091,293, filed Dec. 12, 2014.
European Search Report for EP Application No. 15203247; dated Jul. 18, 2016.

*Primary Examiner* — Kayla McCaffrey
(74) *Attorney, Agent, or Firm* — Cantor Colburn LLP

(57) ABSTRACT

An airfoil includes an airfoil body extending from an inner diameter platform to an opposed outer diameter platform along a longitudinal axis. The airfoil body defines a leading edge and a trailing edge and has a cavity defined between the leading edge, the trailing edge, the inner diameter platform and the outer diameter platform. The cavity includes an airfoil protrusion extending inward from an inner surface of the airfoil body. The airfoil includes a baffle body within the cavity extending along a baffle body axis. The baffle body has a baffle protrusion extending along a central protrusion axis at an angle with respect to the baffle body axis. The end of the baffle protrusion abuts an end of the airfoil protrusion. A flow path is defined between the inner surface of the airfoil body and the outer surface of the baffle body.

19 Claims, 3 Drawing Sheets

(51) Int. Cl.
*F01D 9/04* (2006.01)
*F01D 25/12* (2006.01)

(56) References Cited

U.S. PATENT DOCUMENTS

| | | | | |
|---|---|---|---|---|
| 5,120,192 | A * | 6/1992 | Ohtomo | F01D 5/189 415/115 |
| 7,497,655 | B1 * | 3/2009 | Liang | F01D 5/189 415/115 |
| 8,172,504 | B2 * | 5/2012 | Flodman | F01D 5/189 415/115 |
| 8,348,613 | B2 * | 1/2013 | Gregg | F01D 5/189 415/1 |
| 2004/0265129 | A1 * | 12/2004 | Pabion | F01D 5/189 416/97 R |

* cited by examiner

BAFFLE INSERTS

STATEMENT REGARDING FEDERALLY SPONSORED RESEARCH OR DEVELOPMENT

This invention was made with government support under contract number FA8650-09-D-2923-0021 awarded by the United States Air Force. The government has certain rights in the invention.

BACKGROUND OF THE INVENTION

1. Field of the Invention

The present disclosure relates to airfoils, and more particularly to vane assemblies for gas turbine engines, for example.

2. Description of Related Art

Traditionally, turbomachines, as in gas turbine engines, include multiple stages of rotor blades and vanes to condition and guide fluid flow through the compressor and/or turbine sections. Due to the high temperatures in the turbine section, turbine vanes are often cooled with cooling air ducted into an internal cavity of the vane through a vane platform. In order to reduce the amount of cooling air required to cool turbine vanes, space filling baffles can be provided in the vane cavity to reduce the cavity volume, thereby increasing Mach numbers and heat transfer coefficients for the cooling flow. In certain vane designs, Mach numbers and heat transfer coefficients are not always uniform across various regions of the vane.

Such conventional methods and systems have generally been considered satisfactory for their intended purpose. However, there is still a need in the art for improved blades and vanes. The present disclosure provides a solution for these problems.

SUMMARY OF THE INVENTION

An airfoil includes an airfoil body extending from an inner diameter platform to an opposed outer diameter platform along a longitudinal axis. The airfoil body defines a leading edge and a trailing edge and has a cavity defined between the leading edge, the trailing edge, the inner diameter platform and the outer diameter platform. The cavity includes an airfoil protrusion extending inward from an inner surface of the airfoil body. The airfoil includes a baffle body within the cavity extending along a baffle body axis. The baffle body has a baffle protrusion extending along a central protrusion axis at an angle with respect to the baffle body axis. The end of the baffle protrusion abuts an end of the airfoil protrusion to maintain the position of the baffle body within the airfoil body.

A flow path can be defined between the inner surface of the airfoil body and the outer surface of the baffle body. The cross-sectional area of the flow path can vary along the baffle body axis to control Mach numbers and heat transfer in the flow path. The distance between the inner surface of the airfoil body and an outer surface of the baffle body varies along the baffle body axis to control heat transfer and Mach numbers of fluid flowing through the cavity. The cross-sectional area of the flow path can converge in a direction from the outer diameter platform toward the inner diameter platform to control Mach numbers and heat transfer in the flow path. The airfoil body can include a fluid inlet proximate to the outer diameter platform. The cross-sectional area of the flow path converges in a direction away from the fluid inlet to control Mach numbers and heat transfer in the flow path. The airfoil body can include a fluid inlet proximate to the inner diameter platform. The cross-sectional area of the flow path can converge in a direction away from the fluid inlet to control Mach numbers and heat transfer in the flow path.

In another aspect, the surface area of the end of one of the baffle protrusion or the airfoil protrusion can be greater than the surface area of the end of the other abutting protrusion. The inner surface of the airfoil body can include inwardly extending raised tripping portions. The airfoil protrusion can be one of a plurality of airfoil protrusions and wherein the baffle protrusion is one of a plurality of baffle protrusions. The baffle protrusion can be a first baffle protrusion proximate to a first end of the baffle body. The first baffle protrusion can be shorter than a second baffle protrusion proximate to a second end of the baffle body. The distance between an end of the first protrusion and an outer surface of the baffle body taken along the respective central protrusion axis of the first protrusion is less than that of the second protrusion. The protrusions can extend from a leading edge side of the baffle body, a trailing edge side of the baffle body, a suction side of the baffle body and/or a pressure side of the baffle body. Each airfoil protrusion can abut a respective baffle protrusion.

The distance between the inner surface of the airfoil body and the outer surface of the baffle body taken in a direction normal to the inner surface of the airfoil body can be smaller proximate the platform opposite the fluid inlet than proximate to the other platform to maintain a Mach number and heat transfer. The distance between the inner surface of the airfoil body and the outer surface of the baffle body taken in a direction normal to the inner surface of the airfoil body can be smaller proximate the inner diameter platform of the airfoil body than proximate to the outer diameter platform of the airfoil body to a maintain constant Mach numbers and heat transfer. The distance between the outer surface of the baffle body and the baffle body axis taken in a direction normal to the outer surface of the baffle body can vary along the baffle body axis. The maximum distance from the baffle body axis to the outer surface of the baffle body taken in a transverse direction with respect to the baffle body axis can be less than or equal to the minimum distance from the baffle body axis to the end of each one the baffle protrusions taken in a transverse direction with respect to the baffle body axis.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
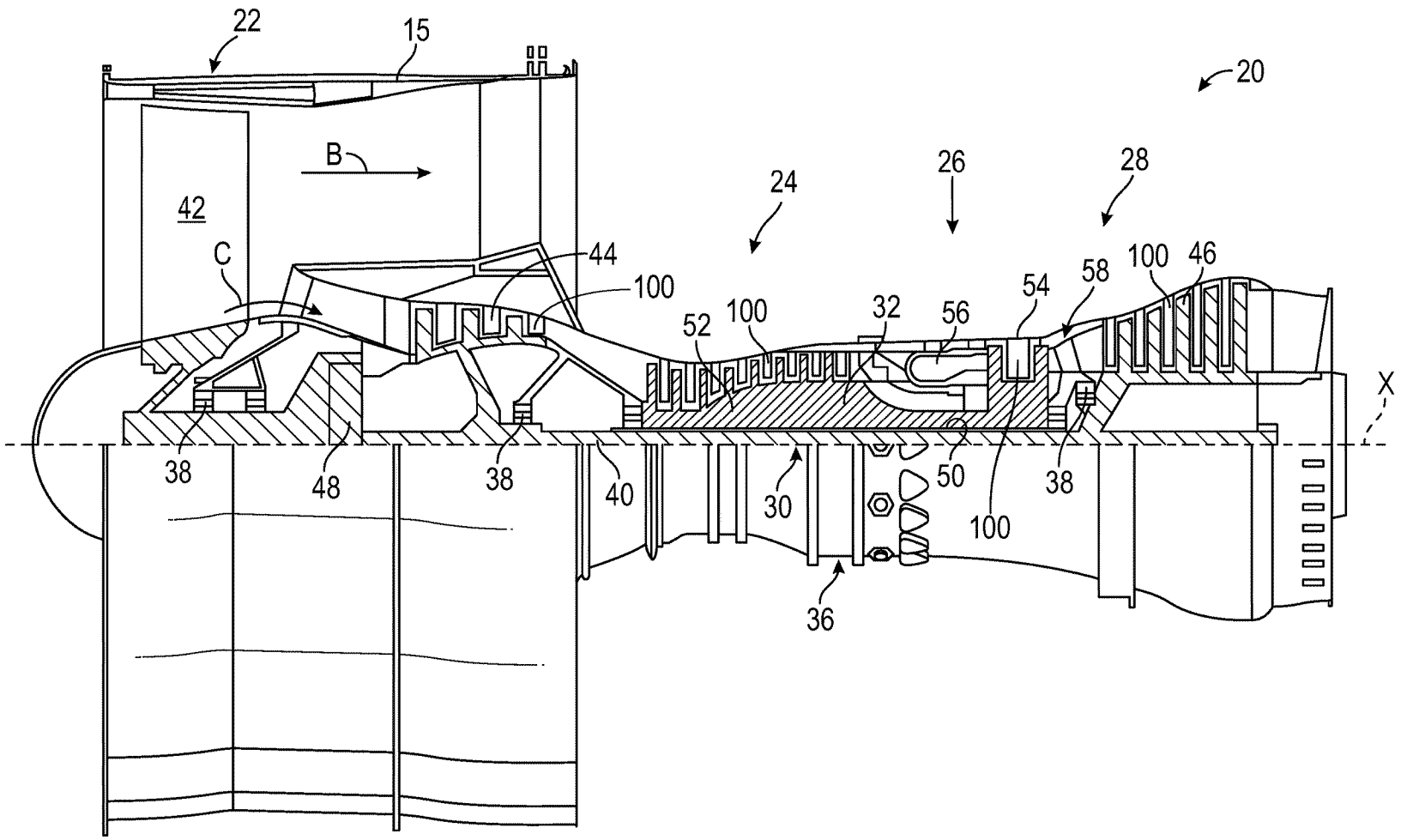
FIG. 1 is a schematic cross-sectional side elevation view of an exemplary embodiment of a gas turbine engine constructed in accordance with the present disclosure, showing locations of vanes.

Reference will now be made to the drawings wherein like reference numerals identify similar structural features or aspects of the subject disclosure. For purposes of explanation and illustration, and not limitation, a cross-sectional side elevation view of an exemplary embodiment of a gas turbine engine accordance with the disclosure is shown in FIG. 1 and is designated generally by reference character 20. Other embodiments of gas turbine engines in accordance with the disclosure, or aspects thereof, are provided in FIGS. 2-6, as will be described. Vanes shown and described herein provide for increased control over Mach numbers and heat transfer between cooling flow paths in the vanes and vane surfaces exposed to high-temperature gases from the gas path.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flow path B in a bypass duct defined within a fan case 15, while the compressor section 24 drives air along a core flow path C for compression and communication into the combustor section 26 then expansion through the turbine section 28. Although depicted as a two-spool turbofan gas turbine engine in the disclosed non-limiting embodiment, it should be understood that the concepts described herein are not limited to use with two-spool turbofans as the teachings may be applied to other types of turbine engines including three-spool architectures.

With continued reference to FIG. 1, the exemplary engine 20 generally includes a low speed spool 30 and a high speed spool 32 mounted for rotation about an engine central axis X relative to an engine static structure 36 via several bearing systems 38. It should be understood that various bearing systems 38 at various locations may alternatively or additionally be provided, and the location of bearing systems 38 may be varied as appropriate to the application.

The low speed spool 30 generally includes an inner shaft 40 that interconnects a fan 42, a low pressure compressor 44 and a low pressure turbine 46. The inner shaft 40 is connected to the fan 42 through a speed change mechanism, which in exemplary gas turbine engine 20 is illustrated as a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged in exemplary gas turbine 20 between the high pressure compressor 52 and the high pressure turbine 54. A mid-turbine frame 58 of the engine static structure 36 is arranged generally between the high pressure turbine 54 and the low pressure turbine 46. The mid-turbine frame 58 further supports bearing systems 38 in the turbine section 28. The inner shaft 40 and the outer shaft 50 are concentric and rotate via bearing systems 38 about the engine central axis X which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The mid-turbine frame includes airfoils which are in the core airflow path C. The turbines 46, 54 rotationally drive the respective low speed spool 30 and high speed spool 32 in response to the expansion. It will be appreciated that each of the positions of the fan section 22, compressor section 24, combustor section 26, turbine section 28, and fan drive gear system 48 may be varied. For example, gear system 48 may be located aft of combustor section 26 or even aft of turbine section 28, and fan section 22 may be positioned forward or aft of the location of gear system 48.

Figure 2:
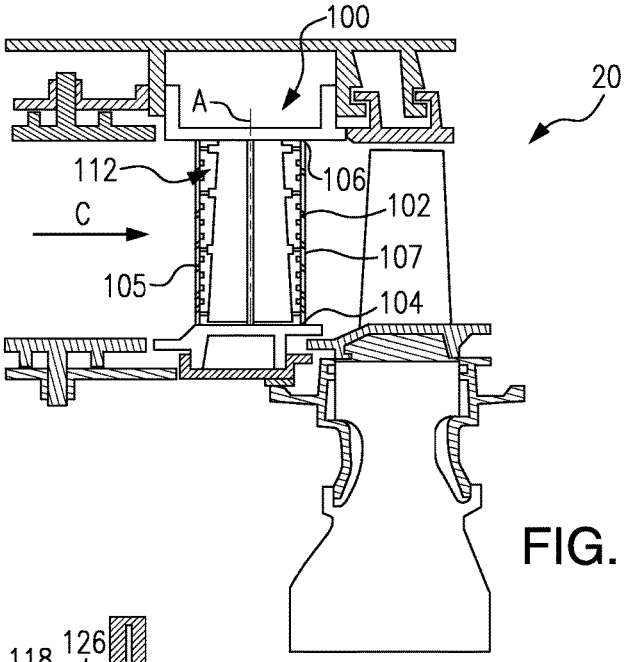
FIG. 2 is a schematic cross-sectional side elevation view of a portion of the gas turbine engine of FIG. 1, showing a vane with baffle inserts.

Now with reference to FIGS. 1 and 2, compressor section 24, combustor section 26 and turbine section 28 include vanes 100. Each vane 100 includes a vane body 102 extending from an inner diameter platform 104 to an opposed outer diameter platform 106 along a longitudinal axis A. Vane body 100 defines a leading edge 105 and a trailing edge 107. A cavity 112 is defined between leading edge 105, trailing edge 107, inner diameter platform 104 and outer diameter platform 106.

Figure 3:
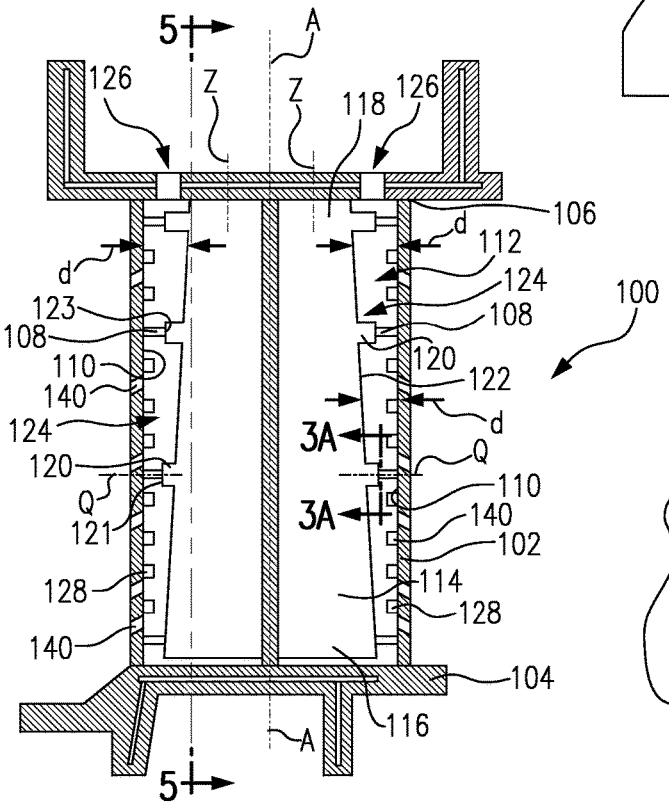
FIG. 3 is a schematic cross-sectional side elevation view of a vane constructed in accordance with the present disclosure, showing vane protrusions extending inward from an inner surface of the vane and baffle protrusions extending outward from an outer surface of the baffle.

As shown in FIGS. 2 and 3, cavity 112 includes airfoil protrusions 108 extending inward from an inner surface 110 of vane body 102. Vane 100 includes baffle bodies 114 within cavity 112. Each baffle body 114 extends from a first end 116 to a second end 118 along respective baffle body axes Z. Each baffle body 114 has baffle protrusions 120 extending along respective central protrusion axes Q at an angle with respect to baffle body axis Z. Protrusions extend from a leading edge side of one of the baffle bodies 114, e.g. the side proximate to leading edge 105, and a trailing edge side of the other baffle body 114, e.g. the side proximate to trailing edge 107. An end 121 of each baffle protrusion 120 abuts an end 123 of each respective airfoil protrusion 108 to maintain the position of baffle body 114 within vane body 102. Because both vane and baffle bodies 102 and 114, respectively, both have protrusions, part of a flow path 124, described in more detail below, is set by baffle protrusions 120 and part of flow path 124 is set by airfoil protrusions 108, making insertion of baffle bodies 114 into vane cavity 112 during assembly easier. Inner surface 110 of vane body 102 includes inwardly extending raised tripping portions 128. Vane body 102 includes cooling holes 140 in fluid communication with flow path 124 to provide cooling air to an exterior surface of vane body 102

As shown in FIG. 3, a distance d between inner surface 110 of vane body 102 and an outer surface 122 of baffle body 114, taken in a direction normal to inner surface 110 of vane body 102, varies along baffle body axis Z to control heat transfer and Mach numbers of fluid flowing through cavity 112. For example, distance d is smaller proximate inner diameter platform 104 than proximate to outer diameter platform 106.

A flow path 124 is defined between inner surface 110 of vane body 102 and outer surface 122 of baffle body 114. Vane body 102 includes a fluid inlet 126 proximate to outer diameter platform 106. The cross-sectional area of flow path 124 converges in a direction away from fluid inlet 126 to control Mach numbers and heat transfer in flow path 124. For example, cross-sectional area of flow path 124 converges in a direction from outer diameter platform 106 toward inner diameter platform 104, providing substantially constant Mach numbers and heat transfer throughout flow path 124 as flow is bled off through cooling holes 140. Whereas, traditionally, the cross-sectional area of flow paths between a baffle body and an inner vane surface have been relatively constant in order to facilitate the insertion of the baffle. Since cooling flow typically enters through a fluid inlet on one side of the vane and is bled out through cooling holes, similar to cooling holes 140, in the vane, Mach numbers and heat transfer, in traditional embodiments, tend to decrease the further the flow is from the inlet, resulting in high metal temperatures at the end of the flow path.

Figure 3A:
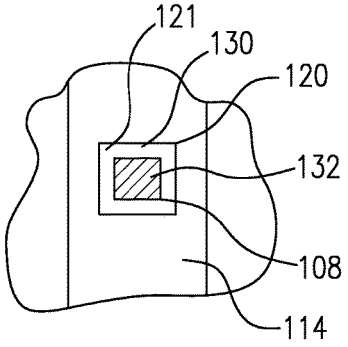
FIG. 3A is a schematic cross-sectional front elevation view of a portion of the vane of FIG. 3, showing the surface areas of the baffle protrusion and the airfoil protrusion.

FIG. 3A shows a cross-sectional view of the contact surfaces for airfoil and baffle protrusions, 108 and 120, respectively. As shown, the surface area 130 of end 121 of baffle protrusion 120 is greater than the surface area 132 of end 123 of airfoil protrusion 108. However, it is contemplated that in alternate embodiments, surface area 132 of end 123 of airfoil protrusion 108 can be greater than surface area 130 of end 121 of baffle protrusion 120. This difference in area ensures that end surfaces 121 of baffle protrusions 120 and end surfaces 123 of airfoil protrusions 108 abut one another despite manufacturing tolerances and thermal growth that occurs during engine operation. While both baffle protrusion 120 and airfoil protrusion 108 are shown as having a rectangular cross-sectional shape with rounded corners it is contemplated that baffle protrusions 120 and airfoil protrusions 108 can have a variety of cross-sectional shapes, for example, circular, oval, ellipse, and the like.

Figure 4:
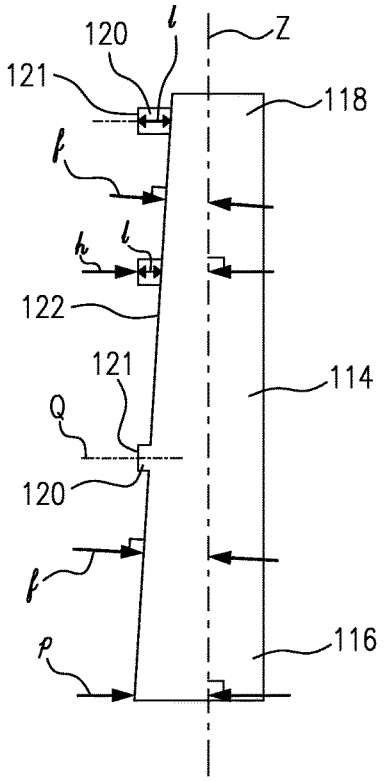
FIG. 4 is a schematic cross-sectional side elevation view of the vane of FIG. 3, showing baffle protrusions of varying lengths extending outward from an outer surface of the baffle.

As shown in FIG. 4, the distance f taken between outer surface 122 of baffle body 114 and baffle body axis Z in a direction normal to outer surface 122 of each baffle body 114 varies along baffle body axis Z. The distance p represents the maximum distance taken from baffle body axis Z to outer surface 122 of baffle body 114 in a transverse direction with respect to baffle body axis Z. In order to insert baffle 114, distance p is less than or equal to the minimum of distances h taken from the baffle body axis Z to the end 121 of each baffle protrusion 120 in a transverse direction with respect to baffle body axis Z. Furthermore, the distance l between an end 121 of a first one of baffle protrusions 120 and an outer surface 122 of baffle body 114, e.g. also at the base of protrusion 120, taken along the respective central protrusion axis Q of the first protrusion is greater than a similar distance l taken along the respective central protrusion axis Q of a second one of baffle protrusions 120. For example, baffle protrusions 120 proximate to second end 118 of baffle body 114 are longer than baffle protrusions 120 proximate to first end 116 of baffle body 114.

Figure 5:
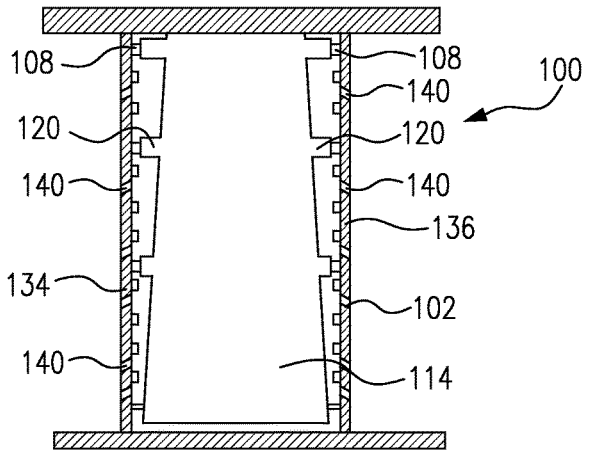
FIG. 5 is a schematic cross-sectional front elevation view of the vane of FIG. 3, showing baffle protrusions extending outward from pressure and suction sides of the baffle.

With reference now to FIG. 5, baffle protrusions 120 and corresponding airfoil protrusions 108 also extend from a suction side of baffle body 114, e.g. the side facing a suction side 134 of vane body 102, and a pressure side of baffle body 114, e.g. the side facing a pressure side 136 of vane body 102. Those skilled in the art will readily appreciate that baffle protrusions 120 can be positioned in a variety of places with respect to the airfoil body, e.g. vane body 102, in which they are disposed, depending on the alignment and cooling required.

Figure 6:
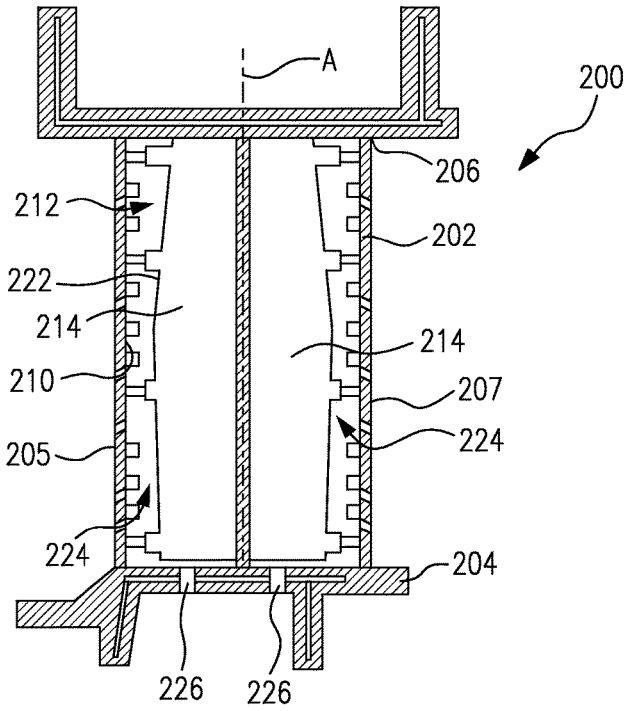
FIG. 6 is a schematic cross-sectional side elevation view of a vane constructed in accordance with the present disclosure, showing a flow channel with a cross-sectional area that converges from both ends towards the middle of the cavity.

With reference now to FIG. 6, vane 200 includes a vane body 202 extending from an inner diameter platform 204 to an opposed outer diameter platform 206 along a longitudinal axis A. Vane body 200 defines a leading edge 205 and a trailing edge 207. A cavity 212 is defined between leading edge 205, trailing edge 207, inner diameter platform 204 and outer diameter platform 206. Vane body 202 includes a fluid inlet 226, similar to fluid inlet 126, proximate to inner diameter platform 204 instead of outer diameter platform 206. Vane cavity 212 includes baffle bodies 214 that increase in width approaching the center of baffle body 114.

With continued reference to FIG. 6, a flow path 224 is defined between inner surface 210 of vane body 202 and outer surface 222 of baffle body 214. The cross-sectional area of flow path 224 first converges in a radial direction away from fluid inlet 226 toward the center of baffle bodies 214 and then diverges from the center of the baffle bodies 214 towards outer diameter platform 206. The configuration of vane 200 tends to assist in aiding heat transfer when the temperature of gas path, e.g. core flow path C, is hottest at midspan of vane body 202. Thus, vanes 100 and 200 show that embodiments of the present disclosure allow the flow path to be tailored to meet heat transfer requirements. While vane bodies, e.g. vane bodies 102 and 202, are shown and described herein as having fluid inlets, e.g. fluid inlets 126 and 226, proximate to an inner diameter platform, e.g. inner diameter platform 104 or 204, or an outer diameter platform, e.g. outer diameter platform 106 or 206, of the vane body, it is contemplated that the vane body can include fluid inlets proximate to both the inner diameter platform and the outer diameter platform of the vane body. Moreover, while shown and described herein, cooling holes 140 may not be necessary in the vane bodies. In which case, the cooling flow can enter either the inner diameter platform or outer diameter platform and exit at the respective opposite end.

Those skilled in the art will readily appreciate that baffles, e.g. baffles 114 and 214, and their respective protrusions, e.g. baffle protrusions 120 and 220, can be manufactured in a variety of ways. For example, baffles can be made from sheet metal and protrusions can be stamped in before forming the baffle shape, baffles and protrusions can be cast together, and/or baffles and protrusions can be additively manufactured. Additionally, the baffles can be used in conjunction with other baffles that do not include baffle protrusions. It is also contemplated that embodiments described herein can readily be used in airfoils other than turbine vanes. For example, they can be used in turbine blades, compressor blades, compressor vanes, or any other suitable airfoil application.

The methods and systems of the present disclosure, as described above and shown in the drawings, provide for airfoils with superior properties including improved heat transfer coefficients and higher Mach numbers, resulting in more efficient cooling. While the apparatus and methods of the subject disclosure have been shown and described with reference to preferred embodiments, those skilled in the art will readily appreciate that changes and/or modifications may be made thereto without departing from the spirit and scope of the subject disclosure.

What is claimed is:

1. An airfoil comprising:

an airfoil body extending from an inner diameter platform to an opposed outer diameter platform along a longitudinal axis, wherein the airfoil body defines a leading edge and a trailing edge, and a cavity defined between the leading edge, the trailing edge, the inner diameter platform and the outer diameter platform, the cavity having an airfoil protrusion extending inward from an inner surface of the airfoil body; and a baffle body within the cavity extending along a baffle body axis, the baffle body having a baffle protrusion extending along a central protrusion axis at an angle with respect to the baffle body axis, wherein the end of the baffle protrusion abuts an end of the airfoil protrusion to maintain the position of the baffle body within the airfoil body, wherein the airfoil body includes a fluid inlet proximate to one of the inner or outer diameter platforms, wherein the distance between the inner surface of the airfoil body and the outer surface of the baffle body taken in a direction normal to the inner surface of the airfoil body is smaller proximate the platform opposite the fluid inlet than proximate to the other platform, wherein the surface area of the end of one of the baffle protrusion or the airfoil protrusion is greater than the surface area of the end of the other abutting protrusion.

2. The airfoil as recited in claim 1, wherein the distance between the inner surface of the airfoil body and an outer surface of the baffle body varies along the baffle body axis.

3. The airfoil as recited in claim 1, wherein a flow path is defined between the inner surface of the airfoil body and the outer surface of the baffle body, and wherein the cross-sectional area of the flow path varies along the baffle body axis.

4. The airfoil as recited in claim 1, wherein the airfoil protrusion is one of a plurality of airfoil protrusions and wherein the baffle protrusion is one of a plurality of baffle protrusions, wherein each baffle protrusion abuts a respective airfoil protrusion.

5. The airfoil as recited in claim 1, wherein the baffle protrusion is a first baffle protrusion proximate to a first end of the baffle body, wherein the first baffle protrusion is shorter than a second baffle protrusion proximate to a second end of the baffle body.

6. The airfoil as recited in claim 1, wherein the distance between the outer surface of the baffle body and the baffle body axis taken in a direction normal to the outer surface of the baffle body varies along the baffle body axis.

7. The airfoil as recited in claim 1, wherein the maximum distance from the baffle body axis to the outer surface of the baffle body taken in a transverse direction with respect to the baffle body axis is less than or equal to the minimum distance from the baffle body axis to the end of the baffle protrusion taken in a transverse direction with respect to the baffle body axis.

8. The airfoil as recited in claim 1, wherein the inner surface of the airfoil body includes inwardly extending raised tripping portions.

9. An airfoil comprising:

an airfoil body extending from an inner diameter platform to an opposed outer diameter platform along a longitudinal axis, wherein the airfoil body defines a leading edge and a trailing edge, and a cavity defined between the leading edge, the trailing edge, the inner diameter platform and the outer diameter platform, the cavity having an airfoil protrusion extending inward from an inner surface of the airfoil body; and a baffle body within the cavity extending along a baffle body axis, the baffle body having a baffle protrusion extending along a central protrusion axis at an angle with respect to the baffle body axis, wherein the end of the baffle protrusion abuts an end of the airfoil protrusion to maintain the position of the baffle body within the airfoil body, wherein the airfoil body includes a fluid inlet proximate to the outer diameter platform, wherein a flow path is defined between the inner surface of the airfoil body and the outer surface of the baffle body, wherein the cross-sectional area of the flow path converges in a direction away from the fluid inlet, wherein the surface area of the end of one of the baffle protrusion or the airfoil protrusion is greater than the surface area of the end of the other abutting protrusion.

10. The airfoil as recited in claim 9, wherein the distance between the inner surface of the airfoil body and an outer surface of the baffle body varies along the baffle body axis.

11. The airfoil as recited in claim 9, wherein a flow path is defined between the inner surface of the airfoil body and the outer surface of the baffle body, and wherein the cross-sectional area of the flow path varies along the baffle body axis.

12. The airfoil as recited in claim 9, wherein the airfoil protrusion is one of a plurality of airfoil protrusions and wherein the baffle protrusion is one of a plurality of baffle protrusions, wherein each baffle protrusion abuts a respective airfoil protrusion.

13. The airfoil as recited in claim 9, wherein the baffle protrusion is a first baffle protrusion proximate to a first end of the baffle body, wherein the first baffle protrusion is shorter than a second baffle protrusion proximate to a second end of the baffle body.

14. The airfoil as recited in claim 9, wherein the distance between the outer surface of the baffle body and the baffle body axis taken in a direction normal to the outer surface of the baffle body varies along the baffle body axis.

15. The airfoil as recited in claim 9, wherein the maximum distance from the baffle body axis to the outer surface of the baffle body taken in a transverse direction with respect to the baffle body axis is less than or equal to the minimum distance from the baffle body axis to the end of the baffle protrusion taken in a transverse direction with respect to the baffle body axis.

16. The airfoil as recited in claim 9, wherein the inner surface of the airfoil body includes inwardly extending raised tripping portions.

17. An airfoil comprising:

an airfoil body extending from an inner diameter platform to an opposed outer diameter platform along a longitudinal axis, wherein the airfoil body defines a leading edge and a trailing edge, and a cavity defined between the leading edge, the trailing edge, the inner diameter platform and the outer diameter platform, the cavity having an airfoil protrusion extending inward from an inner surface of the airfoil body; and a baffle body within the cavity extending along a baffle body axis, the baffle body having a baffle protrusion extending along a central protrusion axis at an angle with respect to the baffle body axis, wherein the end of the baffle protrusion abuts an end of the airfoil protrusion to maintain the position of the baffle body within the airfoil body, wherein the airfoil body includes a fluid inlet proximate to the inner diameter platform, wherein a flow path is defined between the inner surface of the airfoil body and the outer surface of the baffle body, wherein the cross-sectional area of the flow path converges in a direction away from the fluid inlet, wherein the surface area of the end of one of the baffle protrusion or the airfoil protrusion is greater than the surface area of the end of the other abutting protrusion.

18. The airfoil as recited in claim 17, wherein the distance between the inner surface of the airfoil body and an outer surface of the baffle body varies along the baffle body axis.

19. The airfoil as recited in claim 17, wherein a flow path is defined between the inner surface of the airfoil body and the outer surface of the baffle body, and wherein the cross-sectional area of the flow path varies along the baffle body axis.

* * * * *